US006299959B1

(12) United States Patent
Squires et al.

(10) Patent No.: US 6,299,959 B1
(45) Date of Patent: Oct. 9, 2001

(54) FILLED SYNTHETIC GRASS

(75) Inventors: Troy Squires, Leander, TX (US); L. Alan Cole; Raymond Walker, both of Dalton, GA (US)

(73) Assignee: Southwest Recreational Industries, Inc., Leander, TX (US)

( * ) Notice: Subject to any disclaimer, the term of this patent is extended or adjusted under 35 U.S.C. 154(b) by 0 days.

(21) Appl. No.: 09/394,378

(22) Filed: Sep. 10, 1999

Related U.S. Application Data

(60) Provisional application No. 60/100,029, filed on Sep. 11, 1998.

(51) Int. Cl.[7] ..... D05C 17/02

(52) U.S. Cl. ..... 428/87; 428/95; 428/17; 428/331

(58) Field of Search ..... 428/17, 85, 95, 428/331, 327, 87

(56) References Cited

U.S. PATENT DOCUMENTS

| | | | | |
|---|---|---|---|---|
| 4,044,179 | | 8/1977 | Haas | 428/17 |
| 4,336,286 | | 6/1982 | Tomarin | 428/17 |
| 4,337,283 | * | 6/1982 | Haas, Jr. . | |
| 4,389,435 | | 6/1983 | Haas | 428/17 |
| 4,396,653 | | 8/1983 | Tomarin | 428/17 |
| 4,426,415 | | 1/1984 | Avery | 428/95 |
| 4,497,853 | | 2/1985 | Tomarin | 428/17 |
| 4,522,857 | * | 6/1985 | Higgins . | |
| 4,637,942 | | 1/1987 | Tomarin | 428/17 |
| 4,655,635 | | 4/1987 | Furukawa | 404/108 |
| 4,705,706 | | 11/1987 | Avery | 428/95 |
| 5,026,580 | | 6/1991 | Hammon | 273/195 |
| 5,041,320 | | 8/1991 | Meredith et al. | 428/87 |
| 5,205,562 | | 4/1993 | Hammon | 273/195 |
| 5,601,886 | * | 2/1997 | Ishikawa et al. . | |
| 5,958,527 | * | 9/1999 | Prevost . | |
| 5,962,101 | * | 10/1999 | Irwin, Sr. et al. . | |

FOREIGN PATENT DOCUMENTS

| | | | |
|---|---|---|---|
| 530694 | 4/1980 | (AU) | A63C/19/00 |

* cited by examiner

*Primary Examiner*—Deborah Jones
*Assistant Examiner*—Wendy Boss
(74) *Attorney, Agent, or Firm*—Miller & Martin LLP

(57) ABSTRACT

The improved top dressed synthetic turf according to the patent invention provides thatch like fibers to retain top dressing and particularly the rubber or resilient particles in the dressing. The grasslike surface is formed by polyethylene co-polymer slit fibers more than two inches in height tufted through a fiberglass reinforced backing. The thatch zone fibers are dense and texturized so that they will contract to only about one inch in height after curing.

7 Claims, 1 Drawing Sheet

FILLED SYNTHETIC GRASS

PRIORITY CLAIM

The present application claims priority to Provisional Patent Application No. 60/100,029 filed Sep. 11, 1998.

BACKGROUND OF THE INVENTION

1. Field of the Invention

The present invention relates to an improved synthetic grass surface that is filled with a mixture of sand and resilient particles, or resilient particles alone or in other combinations.

2. Description of Related Art

Synthetic turf surfaces have become widely known for use as playing field surfaces for athletic games such as tennis, football, soccer, baseball, field hockey and even golf. Such playing field surfaces are most frequently made of artificial turf or synthetic grasslike carpeting which simulate natural grass fields. Although the best of these artificial turf fields, such as those sold under the ASTROTURF brand by the assignee Southwest Recreational Industries, Inc., provide synthetic playing surfaces which closely simulate the appearance and physical character of natural turf, there is significant expense involved in knitting that synthetic turf and preparing and installing an appropriate cushioning and drainage system with that turf.

Therefore, in order to achieve a highly durable less expensive synthetic turf playing surface, there have been a number of attempts made to utilize top dressings or fillings for synthetic turf.

One problem with such filled turfs has been the tendency of the filling, usually sand, to compact over time. Thus, these surfaces have not always proved satisfactory for contact sports because the compaction of the top dressing limits the shock absorbing ability of the surface and because sand top dressing is abrasive. In an effort to remedy this problem, U.S. Pat. Nos. 4,337,283; 4,396,653; and 5,041,320 all propose introducing some shock absorbing or resilient particles.

Initial effects by the assignee to develop an economical grass-like all weather surface resulted in turf without sufficient stability, with greater than desirable abrasiveness and without adequate retention capabilities for the resilient particles.

Thus, there remains a need for a highly durable, less expensive synthetic playing surface which provides the appropriate degree and type of resiliency and does not compact over time.

SUMMARY OF THE INVENTION

The invention herein relates to the provision of a synthetic grass having both surface forming fibers and dense thatch zone forming fibers to add resilience and to lock in rubber granules which are distributed more densely near the base of the fibers. In one embodiment of this arrangement, the covering rubber like particles stabilize the synthetic surface fibers in their upright position and provide resiliency and sand like filling is mixed with the rubber particles in the upper levels to produce a predetermined and controlled surface resiliency. The thatch zone forming fibers prevent the rubberlike resilient particles form migrating or escaping the turf. With this arrangement, it is also necessary to reinforce the backing fabric, into which the grasslike and thatch zone fibers are tufted, with fiberglass. Thus the backing fabric preferably consists of a laminate of a fabric with a fiberglass reinforcing matrix and a polyester fabric. After tufting, the backing is sprayed with an resilient latex type or other carpet adhesive to lock in the tufted fibers. Although the grasslike surface forming fibers can conceivably be made of many olefins such as polypropylene, polyethylene or their co-polymers, the polyethylene co-polymers are generally less abrasive. The top dressing may be the sand/rubber mix described above, may consist solely of resilient particles, or may be a combination of resilient particles and polymer beads or pellets.

It is therefore an object of the invention to provide an inexpensive, easily applied synthetic grass to produce a playing field of desired resiliency or firmness.

It is another object of the invention to provide a synthetic playing surface for athletic games which is top dressed with relatively inexpensive materials and which provides reduced compaction, while retaining the top dressing over time.

It is yet a further object of the invention to provide a synthetic grass surface which is easier and less expensive to maintain than natural turf.

The combination of backing fabric, grasslike and roots zone fibers and varied top filling provides an extremely durable surface suitable for high use areas such as soccer goal mouths, school yards, playgrounds and multi-sport areas.

It is another object of the invention to provide a well stabilized surface that does not substantially shrink, expand or stretch as a result of temperature changes or heavy wear, and may be played upon with either light or heavy weights of top dressing.

These and other objects of the invention are achieved by providing a playing surface for athletic games comprised of fiberglass reinforced backing fabric, a tufted grasslike polyethylene co-polymer fiber component, a dense tufted nylon 6.6 root zone component, and top filling comprised of rubber granules and optional polymer or sand components wherein composition of the mixture may be adjusted based on the distance from the backing fabric. Additional objects and advantages of the invention will be set forth in part in the following description, or may be obvious from the description or accompanying drawings, or may be learned through practice of the invention.

The accompanying drawings, which are incorporated in and constitute a part of the specification, illustrate several embodiments of the invention and together with the description, serve to explain the principles of the invention.

Figure 1:
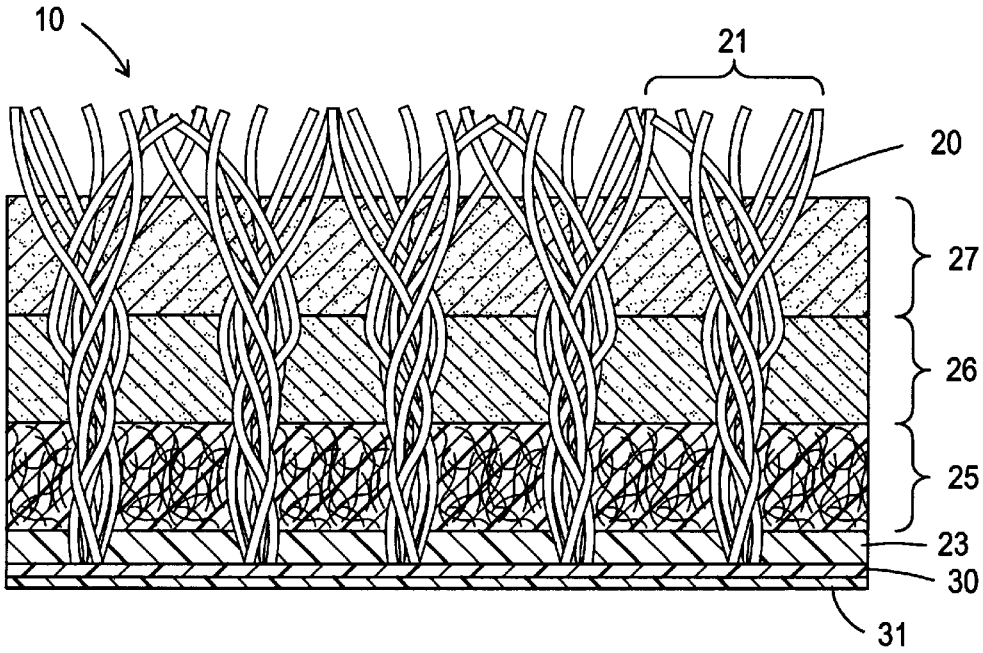
FIG. 1 is a side elevation illustrating synthetic turf according to the present invention.
Figure 2:
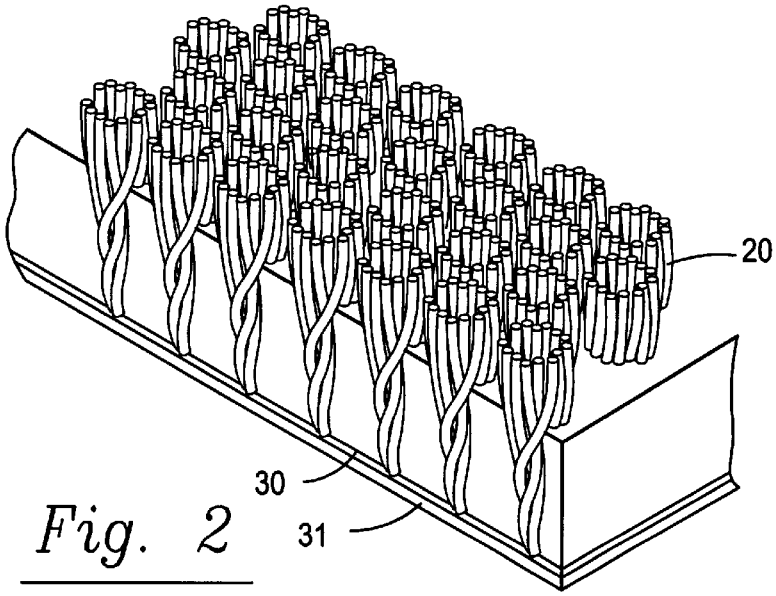
FIG. 2 is a perspective view of an embodiment of synthetic turf according to the present invention.
Figure 3:
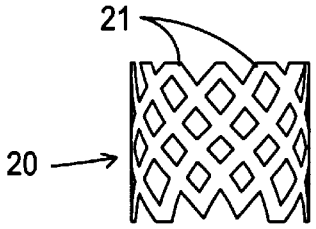
FIG. 3 is an enlarged view of the preferred slit film artificial grass filaments according to the present invention in isolation.
Figure 4:
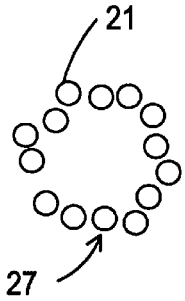
FIG. 4 is a top view of a single artificial grass filament embedded in the top dressing of a synthetic turf according to the present invention.

Repeat use of reference numerals in the present specification represent like, similar on analogous parts, features or elements of the present invention throughout several views.

DETAILED DESCRIPTION OF THE DRAWINGS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield still a further embodiment. Thus, it is intended that the present invention covers such modifications and variations as come within the scope of the appended claims and their equivalents.

The present invention is concerned with a top dressed or filled synthetic grass. Accordingly, FIG. 1 shows a side elevation of a preferred synthetic turf according to the present invention and its constituent components. These components include the grasslike surface forming fibers 20 which are in a slit ribbon form when tufted through the composite backing sheet composed of a fabric with a reinforcing fiberglass matrix 31 and standard polypropylene fabric 30, and the thatch like texturized nylon 6.6 fibers 23 which are also tufted through the composite backing sheet 30, 31.

FIG. 1 also shows three separate layers of top dressing or filling. The lower thatch layer 25 is comprised of rubber granules mixed with between about 0% to 30% sand. Preferably the layer is substantially all rubber granules to provide improved drainage and longer lasting resilience. The height of this layer is about one half inch and the rubber granules are between about 15 and 50 U.S. Screen Mesh size, preferably Black SBR Rubber Crumb of 0.5 to 1.5 mm. The middle layer 26 is comprised of a rubber crumb and sand mixture. In this layer, the mixture is about 50%–75% rubber crumb and about 25%–50% sand, preferably approximately 60% rubber crumb and 40% sand. The top layer of top dressing 27 is again a mixture, but composed of about 25%–50% rubber crumb and 50%–75% sand, preferably about 40% rubber crumb and 60% sand. The sand is preferably round Morie Industrial Sand between about 30 and 50 U.S. Screen Mesh size. Tips 21 of the grasslike fibers will typically protrude from the top layer of dressing 27.

The grasslike fibers 20 are tufted to a minimum two inch or 50 mm pile height and are made of polypropylene or polyethylene co-polymer slit film yarn having a denier between about 7600 and 8000. Such fibers are typically between about 0.40 and 0.75 inches wide. Preferably these fibers are tufted to about a 2.5 inch height though heights between 2 and 3 inches will be suitable for various applications. The "thatch zone" yarn is preferably a bundle of at least four strands of texturized nylon 6.6 monofilament ribbon with a denier of between about 350 and 800 and tufted to a minimum length of about two inches finished pile height.

The backing fabric typically consists of a top layer 31 of standard woven polypropylene and a lower layer of roofing membrane fabric 30 or a similar material consisting of a nonwoven fabric saturated with a binder and calendared with fiberglass to form a fiberglass reinforcing matrix. The composite backing material is fed through a tufting machine, preferably of about 5/16 gauge. The tufting machine is threaded with an A, B pattern, the A needles being threaded with grasslike fibers 21 and the alternate B needles being threaded with the texturized thatch zone fibers 23. Both the grasslike fibers 20 and thatch zone fibers 23 can be tufted to the same cut pile height of preferably to about 2.5 inches. This can be accomplished on a simple tufting machine without pattern control attachments. In some embodiments, the tufting machine may be adjusted to tuft the thatch zone fibers 23 at a lower height than the grasslike fibers 20.

Because the thatch zone fibers 23 are texturized, they have a tendency to contract and twist after being tufted and cut. After tufting, the backing fabric is coated with a latex or polyurethane binder to lock in the fibers 20, 23. The resulting cut pile fabric is then oven cured to set the secondary binder and this causes the texturized thatch zone fibers 23 to crinkle severely and contract to an overall height of about one inch, resembling thatch like elements of natural grass. The thatch zone fibers 23 of a given bight will tend to intertwine with similar fibers of adjacent bights. Both the grasslike fibers 20 and the thatch zone fibers 23 are tufted at a rate of only about 3 or 4 tufts or bights per linear inch so that within a given square inch of surface there are approximately 5 bights of grasslike fibers 20 and five bights of root zone fibers 23. If the tufting density is substantially increased, beyond about 7 bights per square inch, not only do material costs increase, but the fibers become too dense to permit the penetration of the top dressing to the base of the tufted fabric. Similarly, if the tufting density is below about 3 bights per square inch, the fibers are not generally adequate to form a grasslike surface.

After the fabric is tufted and cured, it is preferably glued to a resilient pad such as a Regupol Convoluted Rubber (R5410 25/7) or Regutex Flat 10 mm pad or a single 20 mm E-Layer Shock pad from Southwest Recreational Industries. The bottom fiberglass backing 31 provides a stronger base for such gluing. The additional resilience from the pad provides safer shock absorption levels.

It will be understood that various adjustments to the composition and structure of the synthetic grass will be desirable. For instance, taller pile heights of the grasslike fibers 20 permit the placement of more top dressing, which in turn provides more cushioning. The aging of the grasslike fibers 20 is also significant. Over time, the tips 21 will tend to fibrillate which gives a denser appearance to the grasslike surface and may help contain the top dressing, and especially the lighter components of the top dressing. In some circumstances, the tips 21 will be mechanically fibrillated either during or immediately subsequent to installation of the top dressing.

Such fibrillation has not generally been deemed necessary, though a certain amount of raking or mechanical working of the top dressing is required. For instance, when the first layer 25 of all rubber crumb is applied, it is necessary to work the resilient particles into the fibers 23 to form the thatch zone. Granulated rubber is preferred as the shredded SBR rubber does not work in among the fibers 23 as easily. EPDM rubber granules may also be utilized, especially in an all rubber top dressing when it is desired not to have a black colored top dressing, due to heat absorption characteristics or for aesthetic reasons. Granulated SBR rubber is generally available from processing of reclaimed automobile tires. Other suitable resilient material has been created from reclaimed athletic shoe soles. For outdoor fields, the resilient materials should have a density greater than water to prevent serious top dressing erosion problems. For indoor fields, additional resilient materials, including granulated foamed polymeric materials may be suitable.

It should be noted that top dressings comprised substantially of resilient particles are lighter than the sand mixture top dressings. As a result, the pure resilient particle top dressings do not provide as much support as sand mixture dressings and the fiberglass reinforcing matrix of the backing fabric is required for a well stabilized surface. Top dressings of substantially all resilient particles may also have a less firm feel than sand/rubber mixtures. To some extent, the feeling of firmness increases as the top dressing settles in. To provide additional firmness without sand, polymer or resin pellets or beads may be added. These pellets are preferably about 2–4 mm in diameter and are added so that the top dressing comprises about 5%–30% pellets and 70%–90% resilient material.

The use of top dressings without sand accomplishes several desirable goals. First, unlike resilient particles and resin beads, sand tends to compact and form a harder playing surface over time. Secondly, sand tends to have or develop sharp edges which will damage the fibers of the synthetic turf after substantial use. Even though "round" sand is available, during play on a top dressed field, the grains of sand chip against one another and create edges sufficient to cut into the fibers. Depending upon the particular application for which a synthetic turf field is intended, it may be desirable to use little or no sand.

Thus while there have been described what are presently believed to be the preferred embodiments of the present invention, those skilled in the art realize that changes and modifications may be made thereto without departing from the spirit of the invention, and it is intended to claim all such changes and modifications as fall within the true scope of the invention.

We claim:

1. A synthetic turf comprising:

(a) a composite backing fabric;

(b) normally substantially upstanding grasslike fibers therefrom, the length of said grasslike fibers being substantially uniform and at least about 2 inches high in height;

(c) thatch zone fibers among the grasslike fibers;

(d) a first top-dressing layer comprising at least about 70% resilient particles and interspersed among the base of the grasslike fibers and the thatch zone fibers and on the backing to a substantially uniform depth of at least about ½ inch; and (e) a second top-dressing layer comprising a mixture of resilient particles mixed with about 5 to 50% sand.

2. A synthetic turf comprising:

(a) a composite backing fabric;

(b) normally substantially upstanding grasslike fibers therefrom, the length of said grasslike fibers being substantially uniform and at least about 2 inches high in height;

(c) thatch zone fibers among the grasslike fibers;

(d) a first top-dressing layer comprising at least about 70% resilient particles and interspersed among the base of the grasslike fibers and the thatch zone fibers and on the backing to a substantially uniform depth of at least about ½ inch; and (e) a second top-dressing layer comprising a mixture of resilient particles mixed with about 5 to 30% pellets by weight.

3. A synthetic turf comprising:

(a) a composite backing fabric;

(b) normally substantially upstanding grasslike fibers therefrom, the length of said grasslike fibers being substantially uniform and at least about 2 inches high in height;

(c) thatch zone fibers among the grasslike fibers;

(d) a first top-dressing layer comprising at least about 80% resilient particles and interspersed among the base of the grasslike fibers and the thatch zone fibers and on the backing to a substantially uniform depth of at least about ½ inch; and (e) a second top-dressing layer interspersed among the grasslike fibers on top of said first layer, said second layer comprising between about 25–50% sand and between about 50–75% resilient particles.

4. The synthetic turf of claim 3 wherein a third top-dressing layer is interspersed among the grasslike fibers on top of said second top-dressing layer, said third top-dressing layer comprising between about 25 to 50% resilient particles and between about 50 to 75% sand.

5. A playing surface for athletic games comprising:

(a) a firm, stable subsurface;

(b) a backing comprising a fiberglass reinforcing matrix;

(c) grasslike fibers tufted through and normally substantially upstanding from said backing having substantially uniform length of at least about two inches;

(d) a first top-dressing layer comprising at least about 70% resilient particles; and (e) a second top-dressing layer comprising a mixture of resilient particles mixed with about 5 to 50% sand.

6. A playing surface for athletic games comprising:

(a) a firm, stable subsurface;

(b) a backing comprising a fiberglass reinforcing matrix;

(c) grasslike fibers tufted through and normally substantially upstanding from said backing having substantially uniform length of at least about two inches;

(d) a first top dressing layer comprising at least about 80% resilient particles; and (e) a second top-dressing layer interspersed among the grasslike fibers on top of said first top-dressing layer, said second top-dressing layer comprising between about 25–50% sand and between about 50–75% resilient particles.

7. The playing surface of claim 6 wherein a third top-dressing layer is interspersed among the grasslike fibers on top of said second top-dressing layer, and said third top-dressing layer comprising between about 25 to 50% resilient particles and between about 50 to 75% sand.

* * * * *